US005566758A

United States Patent [19]

Forester

[11] Patent Number: 5,566,758

[45] Date of Patent: Oct. 22, 1996

[54] METHOD AND APPARATUS FOR DRILLING WELLS IN TO GEOTHERMAL FORMATIONS

[76] Inventor: Buford G. Forester, 8619 Pine Pl., Humble, Tex. 77364

[21] Appl. No.: 483,714

[22] Filed: Jun. 7, 1995

[51] Int. Cl.[6] ..... E21B 33/14

[52] U.S. Cl. ..... 166/285; 166/8; 166/88.2; 166/382; 166/380; 175/57

[58] Field of Search ..... 166/285, 382, 166/380, 88.2, 86.1, 88.1, 89.3, 75.14, 242.1, 242.6, 243; 175/57

[56] References Cited

U.S. PATENT DOCUMENTS

| | | | |
|---|---|---|---|
| 3,976,139 | 8/1976 | Wilder | 166/285 |
| 4,155,404 | 5/1979 | Hollingsworth | 166/285 |
| 4,312,405 | 1/1982 | Wilder | 166/285 |
| 4,326,586 | 4/1982 | Wilder | 166/285 |
| 4,376,463 | 3/1983 | Pattillo et al. | 166/285 X |

*Primary Examiner*—Stephen J. Novosad
*Attorney, Agent, or Firm*—Gunn & Associates, PC

[57] ABSTRACT

The present disclosure sets forth the method and apparatus for installing a casing in a geothermal well. Procedurally, the well is drilled toward but not into the geothermal zone of interest, a surface conductor pipe is cemented in place, a casing sting is then positioned in the well borehole and the bottom portions thereof is cemented in place, tension is then placed in the casing string, and the top end is anchored. With tension in the casing string, wellhead completion steps are carried out and production upwardly the casing string causes the casing string to elongate and thereby reduces the tension in the casing string. An apparatus is disclosed including an external spool having an outer groove which is locked in position with a set of lock pins. The spool has a set of slips of wedge shaped construction on the interior which grip the casing when subjected to hydraulic pressure. This enables the casing string to be held firmly without slipping at the wellhead.

14 Claims, 4 Drawing Sheets

METHOD AND APPARATUS FOR DRILLING WELLS IN TO GEOTHERMAL FORMATIONS

BACKGROUND OF THE DISCLOSURE

The present disclosure is directed to both a method and apparatus for drilling wells, and in particular for drilling wells which are drilled into geothermal formations. Geothermal wells are normally drilled to obtain steam at relatively elevated pressures and temperatures. Particular emphasis must be placed on the elevated temperature. To be sure, when an oil or gas well is drilled, there is a temperature gradient experienced as the well passes through various formations of the earth. Assume for vis h vis illustration that the surface temperature is about 75° F. As a well is drilled to great depths, 10,000 feet, even 15,000 feet or deeper, there is a well known temperature gradient. Absent any geothermal activities in the near region, the temperature experienced by the well drilling equipment increases with depth at a specified rate. That rate, however, assumes the absence of a geothermal formation. A geothermal formation is characterized by the fact that heat radiates outwardly into the various geological strata between the well and the geothermal formation. The geothermal formation normally is porous having water which is captured in near proximity of the relatively hot underground formation. This fills with water which is so hot that, absent the high pressure containment, it would otherwise flash into steam. Thus, when a well is drilled into the formation, the hot water is tapped and released into the well and flashes into steam when exposed to pressure reduction sufficient to permit formation of steam. It is not uncommon for underground formations to achieve a temperature level of 500° F. or 600° F. or even hotter. When tapped, a typically released flow of steam, which is quite hot, travels rapidly at high velocity up the producing well to the surface. It is not uncommon to recover steam at the surface which is delivered at a temperature of perhaps about 500° F. and in many instances even hotter.

This should be contrasted with oil production from equal depths. Ordinarily, the oil is delivered at the ambient temperature of the oil in situ in the oil bearing formation. In other words, the temperature of the oil is fairly well predictable and is normally dependent on the depths which the oil producing formation or tapped. As will be understood, the oil can sometimes be slightly hotter or colder, but it fairly well does not stray excessively from the temperature levels common for that formation.

The present disclosure sets forth a method and apparatus for drilling into geothermal formations which deliver extremely hot water, and more commonly which deliver saturated steam. When steam is delivered, it flows at such high velocities that the production equipment, even to the surface, is heated. Indeed, heat loss is held to a minimum because of the high velocity of the steam flow. Thus, the wellhead equipment can be installed at a high mountainous region where it is typically cold all winter and yet the wellhead equipment can quickly assume the temperature of the produced steam and maintain that temperature as long as production continues.

One of the uses of a geothermal well is that it provides a tremendous amount of energy in the form of heated steam for operation of steam generators and the like. The present disclosure is a method for drilling and an apparatus assisting in the production of steam from such wells. More particularly, a significant and substantial problem is encountered in the operation of such wells. Assume for purposes of illustration that the geothermal well is 6,000 ft. in depth. They can vary widely. In any event, the well typically must be cased so that the produced steam does not erode the borehole, destroy the definite shape or profile of the borehole, thereby destroying the well. The casing is installed in the well at the time of drilling. The casing string is exposed to a tremendous swing in temperature. With the swing in temperature, the casing is heated. It is heated so hot that the casing will elongate and thereby shift the wellhead equipment. Consider in a well of 6,000 ft. that the temperature differential for the casing on the average is 400°. In one example, the casing is installed without steam and without heating from the producing geothermal formation at a temperature of 90° along the length of the casing while after production has been initiated, the casing will be heated to 490° A change of 400° causes elongation of the casing sufficiently great that the casing will move the wellhead equipment unless otherwise constrained. Casing is cemented along the full length of the casing. When the change occurs, the cemented casing will be placed under a strain by virtue of the steam flow. This runs the risk of breaking the bond either between the casing and the cement or between the cement and the open hole. In either instance, it is undesirable. In both instances, it is undesirable because it may risk a migration channel along the casing on the exterior defeating the basic purpose for which the casing is normally cemented in place. As a matter of fact, cementing of the casing is normally required as a matter of good sense in well completion techniques and also as a matter of obedience to various and sundry regulatory agencies. It is highly undesirable that external migration along the cased well occur because such migration may poison clean water or artesiat formations. Artesian formations in adjacent aquafiers can be severely damaged by such migration.

The present disclosure enables the drilling and installation of a casing string in a geothermal well with a view of avoiding the stress which is so commonly encountered once the casing has been heated by the steam flow and a stable temperature has been established. The casing is normally heated so that the casing will move, thereby creating damage either by tearing free at one end or the other of the well, or by breaking the bond in the casing and cement structure which is formed. In the well borehole. The borehole is thus protected by the implementation of the present procedure. This procedure will be described by setting forth a number of sequential operational steps.

In one aspect, the present invention enables one of average skill in the art to drill and complete a geothermal well. The well is drilled by drilling through various formations of the earth toward the geothermal formation of interest. Preferably, when the well is drilled, the well is stopped short of the geothermal formation of interest. As a generalization, the depth of the geothermal formation is normally well known in advance. The depth is normally identified in a wild cat well. In a production well drilled thereafter, it is usually known where the geothermal formation will be. Alternately, with the use of temperature detectors supported in the drill string, and especially at the very bottom portion of the drill stem next to the drill bit, temperature measurements can be obtained and the temperature measurements can be used to make a prediction of when the geothermal formation will be penetrated. A geothermal formation normally is thermally isolated by the formations there above. To the extent that the geothermal formation is pervious, one or more adjacent formations tend to be impervious. This typically involves a formation which provides effective isolation to the geothermal formation so that the hot water does not penetrate the adjacent formations. While the hot water does not penetrate, heat is transferred into adjacent formations and the temperature will increase even at distances of 50 or 100 ft. from the geothermal formation targeted by the drilling process. Also, the temperature profile at depth might be well known. That adds an incremental increase in temperature as the well is drilled which can be readily known. Examples will be given below in which the, geothermal formation is located at a depth of 6000 ft. Proximity can be detected at least 200 ft. there above.

The procedure of the present disclosure includes the step of drilling to that specified depth. That depth will be distinguished from other depths. The well is cased at the upper portions of the well. The casing is extended to the bottom of the well drilled to that stage, and a cement shoe is then installed so that cement can be pumped down into the annular space. Separate cement jobs are implemented. The first cement job is to anchor a surface conductor string at the surface. The conductor casing string is specifically anchored by the first cement job. The surface cement job has a depth of a few hundred feet. The second cement job is pumped through the casing and cement shoe and flows into the annular space on the exterior of the casing. The second cement job will be defined below in more detail but it is primarily a cement job in which the lower end of the casing is anchored. The casing string is pulled upwardly, and the casing at the top end is cemented to anchor within the surface conductor string. The surface conductor pipe is thus cemented on both the exterior and the interior. Furthermore, the casing is left under tension, being anchored at its lower end, and is cemented in placed by the third cement job. After the casing is placed under tension, it is also equipped with a spool which surrounds the casing which thereafter grips and locks the casing and enables any surplus casing to be cut off. Wellhead equipment is completed and a Christmas tree is installed on the wellhead equipment. The latter step occurs after drilling has extended the well through the cementing shoe and into the producing geothermal formation there below.

While the foregoing mentions a few of the details with regard to the procedure contemplated in practice of the present invention, the structural apparatus of the invention is likewise disclosed in some detail and is incorporated in this brief summary. The wellhead completion equipment particularly emphasizes a sleeve system which holds the casing so that it can be placed under tension.

DETAILED DESCRIPTION OF THE DRAWINGS

So that the manner in which the above recited features, advantages and objects of the present invention are obtained and can be understood in detail, more particular description of the invention, briefly summarized above, may be had by reference to the embodiments thereof which are illustrated in the appended drawings. It is to be noted, however, that the appended drawings illustrate only typical embodiments of this invention and are therfore not to be considered limiting of its scope. The invention may admit to other equally effective embodiments. FIG. 1 is a sectional view through a geothermal well drilled to a specified depth short of the geothermal formation, of interest and further showing a surface casing pipe installed below the wellhead and blow out preventer;

Figure 5:
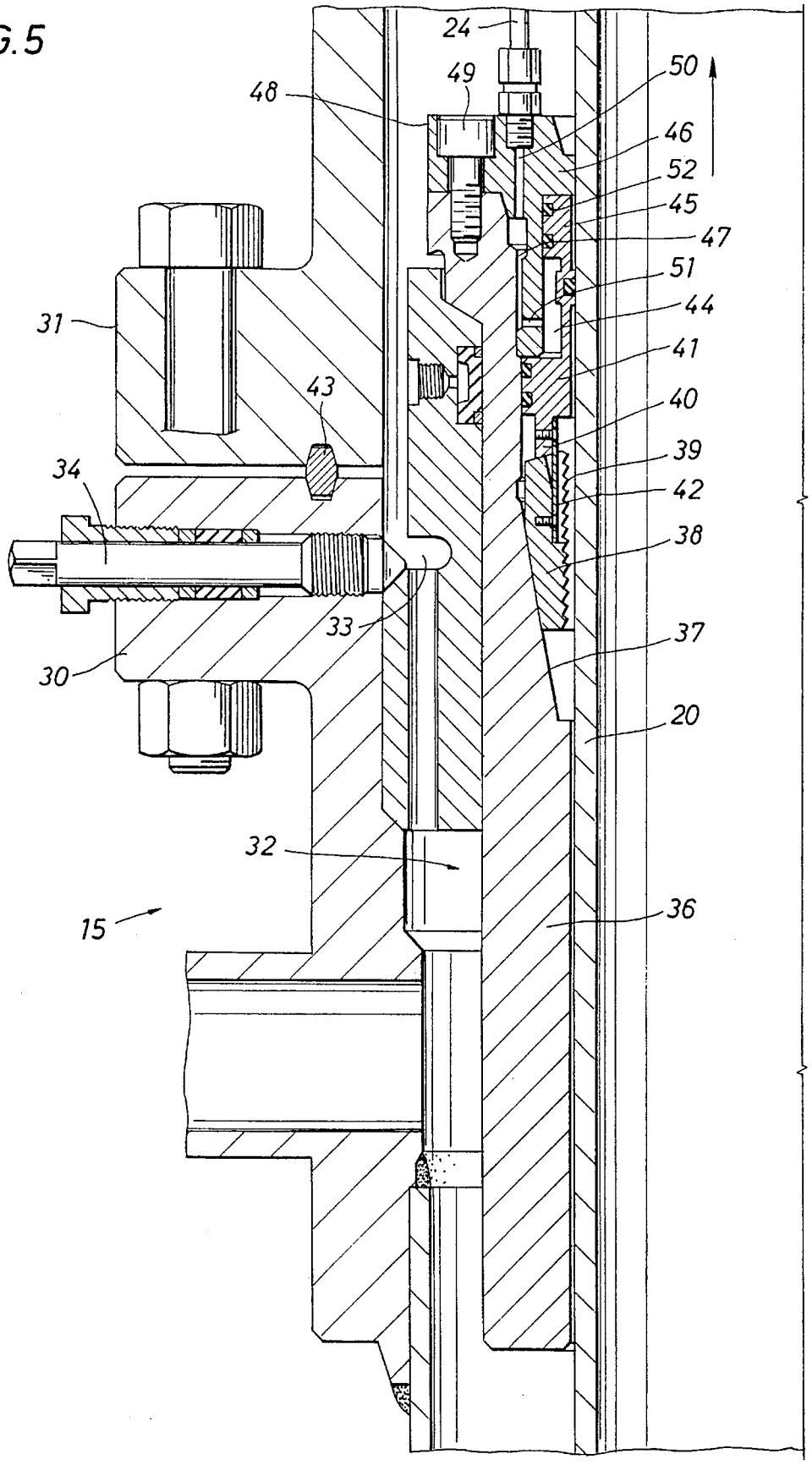
Figure 6:
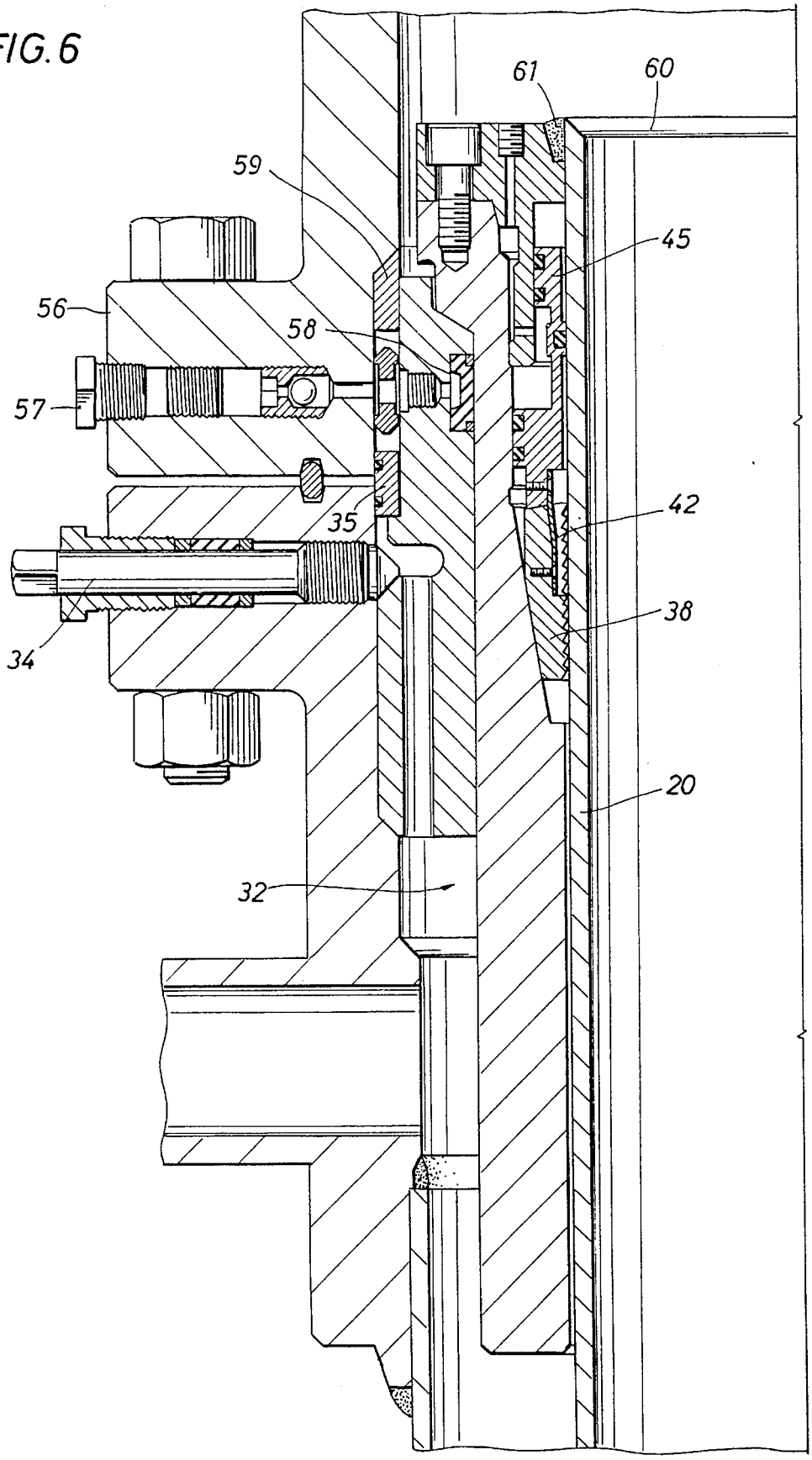

FIG. 5 of the drawings shows certain wellhead equipment for grasping the casing and moving it to a specified position to hold the casing in the well so that the casing is gripped and held firmly; and FIG. 6 is a view similar to FIG. 5 showing a change in the wellhead equipment to lock the casing in place to permit the casing to be welded, and thereby enable production through the geothermal well.

DETAILED DESCRIPTION OF THE PREFERRED EMBODIMENT

Figure 1:
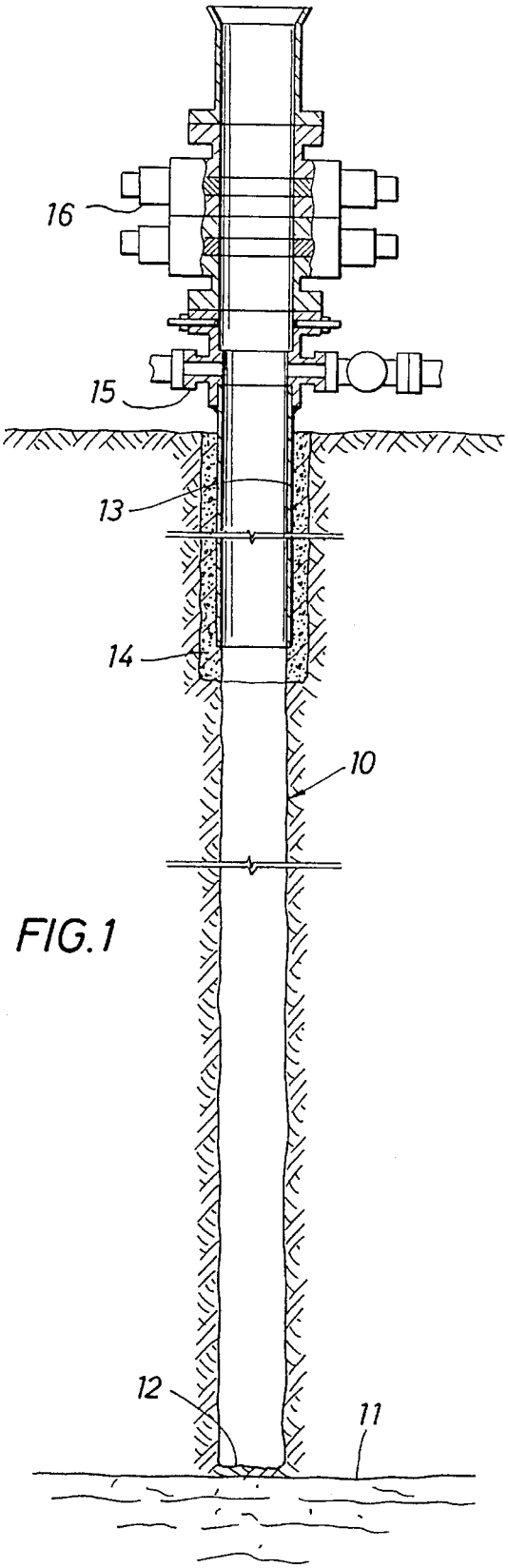

Attention is first directed to FIG. 1 of the drawings where the well borehole 10 has been drilled to a specified depth. The geothermal formation in which hot water is located is identified by the numeral 11. Note that the well 10 has been drilled to the depth 12 which is not the same depth as the formation 11. The depth to the formation 11 will be described as the total depth. When the well is drilled to the depth signified at 12, that is the open hole depth. The distance between the total depth and the open hole depth is sufficient that the hot water under pressure will not burst through this short distance. A typical depth for purposes of teaching in the present disclosure might be 6,000 ft. to the geothermal formation 11 while the depth 12 is 200 ft. short of that. Primarily, that distance depends on the nature of the layers or formation immediately above the geothermal formation.

After drilling has been completed to this stage, a surface conductor pipe 13 is installed in the well and it is cemented in place. By use of a suitable removable plug, cement is pumped in the annular space on the exterior of the surface conductor pipe. The first cement job is indicated at 14. It will be understood that it is used to anchor the surface conductor pipe 13 in place. The surface conductor pipe connects at the wellhead 15. The wellhead 15 is ordinarily connected to the surface conductor pipe 13. Such a connection is obtained either by welding or by a flanged connection. It also typically includes an upwardly facing flange which enables connection of a blowout preventer (BOP hereinafter). The BOP 16 is attached above the wellhead 15. The BOP includes opposing pairs of rams which close to prevent runaway flow through the well should that be triggered. As shown to this juncture, FIG. 1 shows the well in a state where the first cement job has been cured the surface conductor pipe is anchored in place by the first cement job, and there is an open well borehole to the depth 12.

Figure 2:
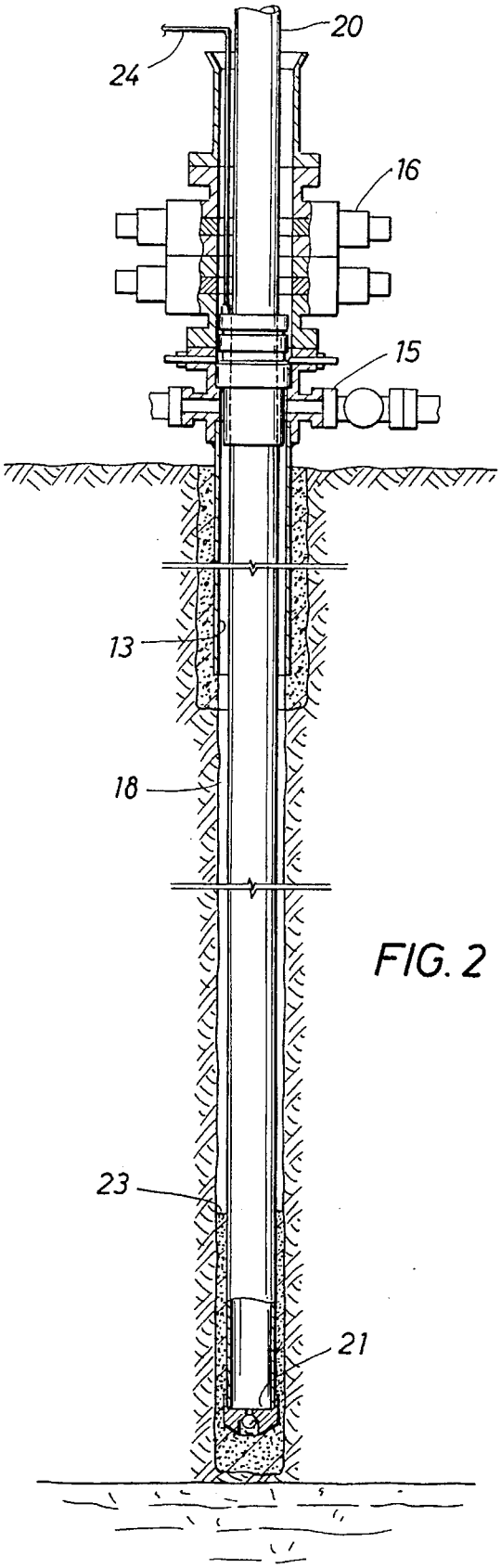
FIG. 2 is a view similar to FIG. 1 in which the apparatus of the present invention has been installed at the wellhead to enable grasping of the casing and further showing a casing string extending from above the BOP to the bottom of the well at a depth as shown in FIG. 1 wherein a cement shoe has been installed and a second cement job has occurred to anchor the lower end of the casing.

Continuing now with FIG. 2 of the drawings, further procedures have been carried out as will be described. A casing string 20 has been placed in the well that extends through the BOP 16. It also passes through the wellhead 15. The casing 16 is smaller. In diameter than the surface conductor pipe 13. The casing 20 defines an annual space on the exterior generally identified by the numeral 18. This annular space 18 extends on the interior of the surface conductor pipe down to the bottom of the well at the depth 12. The casing 20 is extended to the bottom and is preferably equipped with a cement shoe 21. Cement is pumped down through the cement shoe and flows upwardly and around the cement shoe. The second casing job extends upwardly to the level identified as 23. This cement jobs anchors the lower end of the string 20. It is sufficiently long that the entire casing string 20 is anchored by that portion of the casing which is cemented in place. This may require cementing at least 200 or 300 ft. of the casing, or perhaps as much as 500 ft. The casing 20 is therefore anchored at the lower end after the cement has cured and forms a good concrete bond to wall of the formation. As further shown in FIG. 2 of the drawings, the casing 20 extends the full length of the well to the depth 12. This enables the second cement job to be done so that the cement rises in the annular space to the level 23. In one other aspect of the present disclosure, a hydraulic line 24 connects with a spool which is provided with hydraulic fluid. The purpose of this will be more readily apparent hereinafter.

Figure 3:
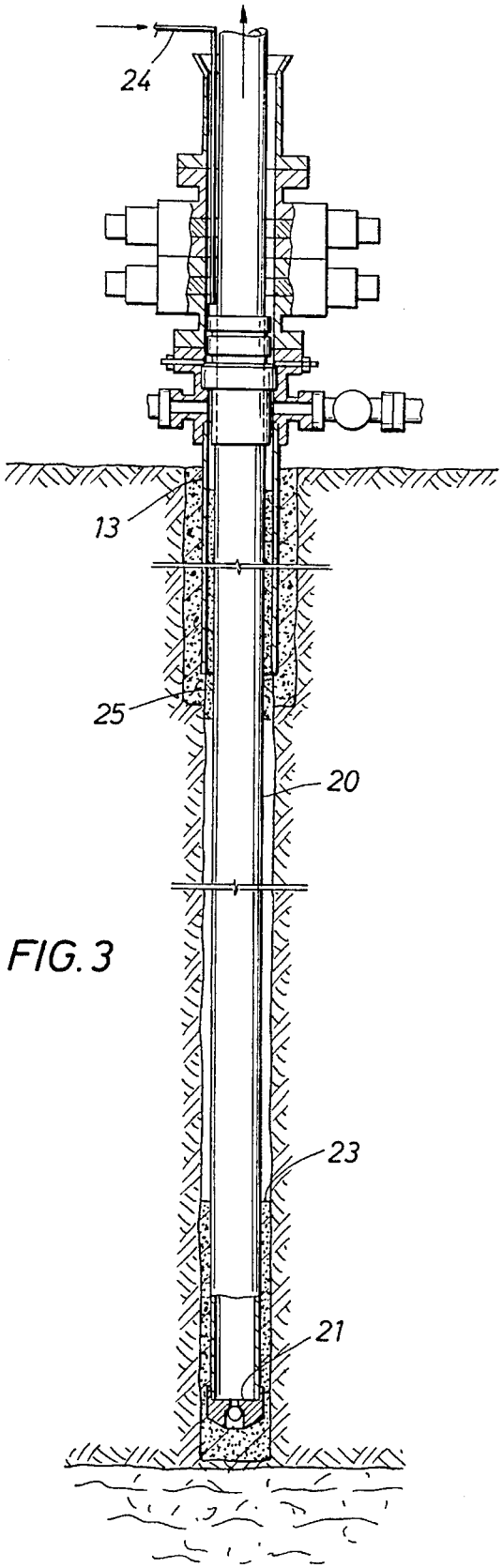
FIG. 3 shows the next step in the procedure wherein tension has been placed on casing string, the casing has been elongated, and the upper end of the casing string has been cemented within the surface conductor pipe.

Going now to FIG. 3 of the drawings, the casing 20 has been anchored by the second cement job. This cement job 23 anchors the lower end so that tension can be placed in the casing 20. The casing is pulled upwardly. By taking an upward pull on the casing, it elongates and is then grasped by a spool to be described. This spool is provided with hydraulic fluid pressure through the line 24. This enables the casing to be clamped and held in the spool. After that has occurred, a third cement job is then applied, typically using a diverter valve well known in the art. The third cement job is identified at the numeral 25. It is formed by cementing on the exterior of the casing 20 and on the interior of the surface casing pipe 13. At this juncture, the surface pipe 13 is cemented both on the exterior and interior. This anchors the casing at the bottom of the casing 20. Tension is applied to the casing between the first and third cement job.

Figure 4:
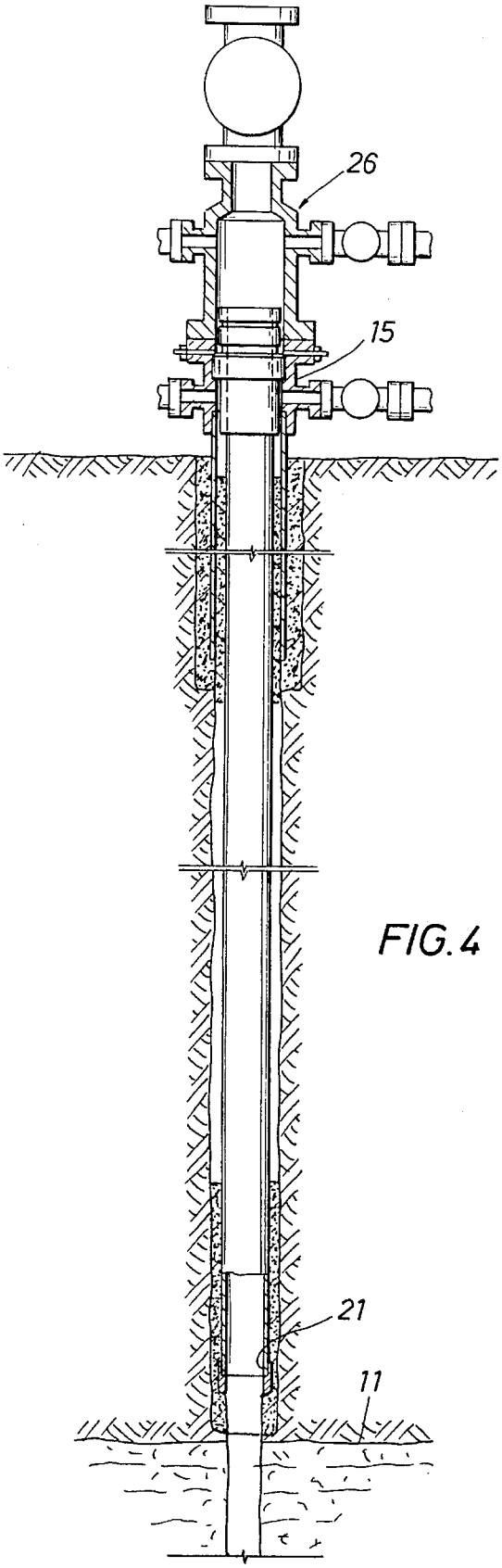
FIG. 4 is a view similar to FIG. 3 showing the casing cut at the installed sleeve of the present invention, the BOP removed, and the wellhead equipment connected so that production can be achieved through the extended geothermal well which now opens into the formation of interest.

Going now to FIG. 4 of the drawing, the casing has been placed under tension, the spool has been operated and the surplus casing has been cut away. Note in contrast with FIG. 3 that the casing no longer extends upwardly from the BOP stack. At this stage, the casing is cut above the spool to be described and the wellhead Christmas tree 26 is attached to the casing above the spool which is also anchored on the wellhead 15. Furthermore, FIG. 4 shows that the well is completed. Completion of the well is carried out after the casing has been placed in tension, after the spool has been affixed to the casing, and surplus casing has been cut away. This is done by drilling completely through the cement shoe 21 to extend the well into the geothermal formation 11. At this time, hot water in the form of steam is produced through the well. The hot water flashes into steam and flows up the casing 20 if not otherwise shut in. This enables production in the ordinary fashion to deliver steam.

As described at this juncture, the system enables drilling of the well and completion of a geothermal well where the casing is exposed at extraordinarily high temperatures.

One important aspect of the improved procedure of the present disclosure is the ability to anchor the casing 20. The casing is anchored in a particular fashion. This requires reference to both FIGS. 3 and 4 for an understanding of operation of the spool support assembly which is better shown in FIG. 5 drawing. An exchange of equipment above the wellhead occurs. In FIG. 5, the upper portions of the wellhead 15 terminates at a surrounding flange 30. The flange 30 matches with a downwardly facing flange 31 affixed to the BOP 16 above. At this stage of proceedings, the casing 20 extends upwardly in FIG. 5 of the drawings and is received through that equipment but is not fastened or anchored. The manner in which that is accomplished will be given. The wellhead encloses a moveable spool 32. The spool 32 can move upwardly and downwardly. It is held in a particular location in a fashion to be described. The spool 32 is formed with an encircling groove 33. A lock pin operating in the fashion of a set screw is extended into the groove. The lock pin 34 terminates at a pointed tip. When threaded into the spool 32, it locks the spool 32 against upward or downward movement. The lock pin 34 anchors the spool so that there is no movement. The spool is held fast at that location. Leakage in this region is prevented by a seal 43 located between the two flanges 30 and 31. In addition, is later added an internal seal 35 which spans the slot between the two Hanged faces. The seal 35 assures that no leakage occurs from the interior to the exterior. The spool 32 is constructed with an elongate telescoping spool 36 on the exterior of the casing 20. It has an internal tapering or sloping surface 37 which receives tapered collet wedges 38 which are constructed with sharp teeth, serrated 39 on the exterior. They are mounted so that they can flex radially inwardly and outwardly as required. The collet wedges 38 are on the ends of a set of collet fingers. There can be several in the circle formed on the interior of the tapered surface. The tapering surface 37 narrows at the lower end. This enables a ring 41 to drive the collet wedges against the sloping surface so that locking is accomplished. The contrast between FIGS. 5 and 6 will show how this operates.

The tapered wedges are affixed to relatively thin fingers 42 which have the form of rectangular, cantilevered tabs from the encircling shoulder 40. In turn, the ring 41 defines one wall of a compression chamber 44. The chamber 44 is defined between two telescoping members, the inside member including the cylindrical ring 45 which is constructed concentric with and on the interior of a larger sub 46. The sub 46 has the form of a surrounding lip or shoulder in an overhang condition. In turn, the sub 46 is received inside a tapered shoulder and counterbore 47. The counterbore terminates at its upward end with an extending flange 48 which is joined by suitable bolts 49 to the top end of the elongate spool 36. On the interior of the spool 36, there is the chamber 44. The hydraulic supply line 24 delivers hydraulic oil under pressure to the chamber 44. The line 24 connects with the feed passage 50. The passage 50 connects to the chamber 44 so that the chamber 44 can be filled through the small passage 51. The chamber 44 is filled for chamber expansion. Leakage from the chamber is prevented by several seals above and below the chamber 44. The seals 52 provide fluid isolation. In FIG. 6, the chamber 44 has been enlarged, causing downward movement of the ring shaped member 45. When it moves downwardly, the springs 42 are bent or deflected. They deflect inwardly as illustrated in contrasting FIGS. 5 and 6.

Shifting now to FIG. 6, the BOP stack has been removed and replaced with wellhead completion equipment appropriate for the spool 32. In this instance, a new flange has been affixed. The new flange 56 incorporates a plugged passage 57 having a check valve in it. The passage permits heavy weight oil to be introduced to pressure actuate a seal ring 58. The seal ring 58 is located adjacent to the spool 36. It is dormant in the illustration of FIG. 5 while it is made active controllably at the desired time. In particular detail, FIG. 6 shows an undercut receptacle holding a seal 59 above the seal 35. It prevents leakage on the exterior of the spool 32. The spool 32 is provided with hydraulic oil through the line 24. When hydraulic pressure has been delivered, the serrated wedges 38 are driven downwardly and take a bite into the metal on the exterior of the casing 20, biting into the casing, and wedging firmly. This holds the casing. When removing the BOP and replacing it with the equipment illustrated in FIG. 6, the top of the casing is exposed. The casing 20 is cut with an internal bevel cut 60 shown at the top of FIG. 6, and is joined by a welded bead 61. The bead 61 locks the casing in place. The casing at this stage is locked to the spool. This locks the casing so that it is not possible to release the casing from the spool 32.

At this point, the spool 32 is held in position by the lock pin 34 on the exterior and is locked to the casing 20 by the wedges 38. It is also held by the weld 61. Hydraulic pressure is no longer required to the line 24. That pressure can be released. An external seal around the system can be obtained by inflating the seal ring 58. If desired, the screw 34 can be removed, and pressure in the annulus can then be sampled through the passage. Preferably, at least four and perhaps as many as 12 of the screws 34 are used to hold the spool in place.

To consider now one important aspect of the present invention, it incorporates a method of clamping the casing so that the casing is held firmly and snugly in place. As described by referring to FIGS. 5 and 6 jointly, clamping of the casing to the spool 32 is shown in some detail. The casing 20 is extended upwardly through the BOP stack 16 and the spool is operated to clamp on the casing. This occurs, however, only after the casing is placed under tension. In other words, it is pulled upwardly in FIG. 3, the spool 32 is then locked snugly around the casing, and the cement procedure is then carried out which places the third cement job 25 in place to secure the casing. After the casing has been cemented in place, it is held in tension by the second and third cement jobs. There is no need to apply tension to the casing above the well head 15. Rather, the external source of tension can be released. It is preferably released after the spool 32 is set. Setting the spool 32 requires the use of hydraulic oil under pressure through the line 24. Going now to FIG. 5 of the drawings, that step is shown after removal of the BOP stack and installation of the Christmas tree 26 along with the fittings necessary to implement spool connection. This is shown in FIG. 5 of the drawings. In this view, the spool is prevented from movement by virtue of the lock pin 34. As noted before, the lock pin is inserted in the matching groove. There are several lock pins incorporated at a common elevation.

Hydraulic pressure is applied to force the sliding wedges 38 downwardly. As they move downwardly, the spring 42 deflects, thereby moving radially inwardly to bring the serrations against the wall of the casing. This grips and holds because the serrations bite into the metal. The top end of the casing at the bead 60 is cut and the weld 61 is placed around the top end to insure proper connection.

One benefit of placing the casing under tension is that it will not move the wellhead equipment once the temperature is raised. The last drilling occurs after the first, second, and third cement jobs have been placed in the well, and after the casing has been gripped by the spool but prior to removal of the BOP 16. At this stage, the last step of drilling is undertaken. It is shown in the contrast in FIG. 4 where the well is drilled into the geothermal zone 11. At this point, it is necessary to shut in the well. The well is usually shut in so that the necessary wellhead connections can be made for delivery of steam to test the flow rates of the well and then to produce the well in a regular fashion.

Once steam begins to flow, the entire casing 20 is heated. As long as there is any flow of measurable amount, the flow will keep the casing at the elevated temperature. At that temperature, it elongates and otherwise pushes the wellhead above the ground. In this instance, that does not occur because the casing is pre-tensioned at a reduced temperature. As the casing string elongates, the central portion of the casing string between the cement at the bottom and the cement at the top undergoes a changing stress. That stress can vary so that the increase in temperature does not cause the upper end of the casing string to break free. Rather, the elongation is accommodated in pre-stressing the casing string. This enables the equipment at both ends of the casing string to be firmly anchored to thereby prevent slippage movement or unintended release. This enables the equipment to hold snugly. This enables the wellhead equipment to support the casing string without apprehension of breaking free of the cement. Indeed, the amount of cement required is reduced through the practice of the present invention. While the foregoing is directed to the preferred embodiment, the scope is determined by the claims which follow:

I claim:

1. A method of drilling a well into a geothermal zone wherein the method comprises the steps of:

(a) drilling a well borehole toward a desired geothermal zone wherein the drilling stops short of the geothermal zone;

(b) positioning a casing string in the drilled well extending from the top of the well substantially to the bottom of the well;

(c) cementing a bottom portion of the casing string in the well borehole;

(d) applying tension to the casing string above the bottom cemented portion; and (e) anchoring the top end of the casing string at or near the surface.

2. The method of claim 1 wherein the step of anchoring the top end of the casing string includes the step of welding the casing string to a fixed wellhead.

3. The method of claim 1 wherein the step of anchoring the top end of the casing string includes the step of clamping the casing string to a fixed wellhead.

4. The method of claim 1 wherein the step of anchoring the top end of the casing string includes the step of cementing the casing string to a fixed wellhead.

5. The method of claim 1 wherein the step of anchoring the top end of the casing string includes the step of pinning the casing string to a fixed wellhead.

6. The method of claim 1 including the step of anchoring the top end of the casing string in the well by positioning the top end of the casing string in a hollow cylindrical spool which connects with the casing string and locking the spool in a wellhead fitting.

7. The method of claim 6 wherein the spool is joined to the casing string by clamping the spool to the casing string on the inside of the spool where the spool fits around the casing string.

8. The method of claim 1 wherein the step of cementing the bottom portion of the casing string includes the step of placing a cement shoe on the bottom end of the casing string and cementing through said cement shoe to anchor the bottom portion of the casing string in the well borehole.

9. The method of claim 8 including the post anchoring step of drilling through the cement shoe to extend the well into the geothermal formation.

10. The method of claim 9 wherein the step of drilling through the cement shoe occurs after anchoring the casing string to a surface conductor pipe around the casing suing.

11. The method of claim 10 including the step of initially cementing in place a surface conductor pipe and positioning the casing suing in the conductor pipe supported by a wellhead, and subsequently cementing the casing suing at the surface to the surface conductor pipe.

12. The method of claim 1 including the step of positioning a spool around the casing prior to tensioning wherein the spool is located below a blowout preventer and including the step of operating the spool hydraulically to set spool supported slips against the pipe to fixedly attach the spool to the casing suing.

13. The method of claim 12 including the step of extending the well borehole through the casing string after the casing suing has been placed in tension, and thereafter producing through the casing string which is increased in temperature to extend or elongate the casing string dependent upon the temperature thereof.

14. The method of claim 1 including the step of positioning a wellhead supporting a spool on the exterior of the casing string, forming an external groove in the spool; and positioning a plurality of fastening pins extending through the wellhead and into the groove in the spool so that the spool is fashioned in position with respect to the wellhead.

* * * * *